US011384749B2

(12) United States Patent
Kuzin et al.

(10) Patent No.: US 11,384,749 B2
(45) Date of Patent: Jul. 12, 2022

(54) PUMP ASSEMBLY

(71) Applicant: OBSHCHESTVO S OGRANICHENNOJ OTVETSTVENNOST'YU "TOREG", Moscow (RU)

(72) Inventors: Egor Vladimirovich Kuzin, Irkutsk (RU); Egor Aleksandrovich Tyukavkin, Irkutsk (RU); Dmitrij Alekseevich Bublik, r.p. Markova (RU)

(73) Assignee: OBSHCHESTVO S OGRANICHENNOJ OTVETSTVENNOST'YU "TOREG", Moscow (RU)

( * ) Notice: Subject to any disclaimer, the term of this patent is extended or adjusted under 35 U.S.C. 154(b) by 228 days.

(21) Appl. No.: 16/760,453

(22) PCT Filed: Oct. 2, 2019

(86) PCT No.: PCT/RU2019/000700
§ 371 (c)(1),
(2) Date: Apr. 30, 2020

(87) PCT Pub. No.: WO2020/071958
PCT Pub. Date: Apr. 9, 2020

(65) Prior Publication Data

US 2020/0340470 A1 Oct. 29, 2020

(30) Foreign Application Priority Data

Oct. 2, 2018 (RU) ..... RU2018134507

(51) Int. Cl.
*F04B 43/113* (2006.01)
*F04B 49/22* (2006.01)
*F04B 43/00* (2006.01)

(52) U.S. Cl.
CPC ..... *F04B 43/1136* (2013.01); *F04B 43/0054* (2013.01); *F04B 43/0072* (2013.01); *F04B 49/22* (2013.01)

(58) Field of Classification Search
CPC ..... F04B 43/1136; F04B 47/00; F04B 15/02; F04B 19/04; F04B 43/0054;
(Continued)

(56) References Cited

U.S. PATENT DOCUMENTS 3,524,714 A * 8/1970 Grove ..... F04B 43/1136 417/345
4,832,580 A * 5/1989 Tsuyoshi ..... F04B 43/086 417/317
(Continued)

FOREIGN PATENT DOCUMENTS

WO 2004/011806 A1 2/2004
WO 2015/128283 A1 9/2015

*Primary Examiner* — Dominick L Plakkoottam
(74) *Attorney, Agent, or Firm* — Nixon & Vanderhye PC

(57) ABSTRACT

A pump assembly includes a housing having two parts with internal cylindrical chambers having openings for the inlet and outlet of a pumped fluid, and two longitudinally deformable bellows fastened inside the respective parts of the housing. The opposite end of each bellows has a plug. On the end surface of the housing the bellows are connected to is an opening for the inlet of a working fluid into the corresponding internal chamber. A hydraulic system for controlling the pump assembly includes a tank containing a working fluid, a positive displacement pump, two independent hydraulic pipelines, and a system of valves for alternately connecting the bellows' internal chambers containing working fluid to the pipelines. The internal chamber of each bellows is alternatingly connected to the positive displacement pump for supplying working fluid by a first hydraulic pipeline and to the working fluid tank by a second hydraulic pipeline.

8 Claims, 9 Drawing Sheets

(58) Field of Classification Search
CPC ..... F04B 43/0072; F04B 43/06; F04B 43/10; F04B 45/033; F04B 49/22; B67D 7/02; B67D 7/0244
See application file for complete search history.

(56) References Cited

U.S. PATENT DOCUMENTS

| | | | | |
|---|---|---|---|---|
| 5,220,943 | A * | 6/1993 | Zink | F04B 43/10 137/565.17 |
| 5,228,473 | A * | 7/1993 | Zink | F04B 43/10 137/565.14 |
| 5,308,230 | A * | 5/1994 | Moore | F04B 43/1136 417/394 |
| 6,575,712 | B1 * | 6/2003 | Slavchev | F04B 45/02 60/497 |
| 8,828,257 | B2 * | 9/2014 | Kitada | H01J 37/32082 204/164 |
| 8,905,001 | B2 * | 12/2014 | Lundgren | F02M 37/0064 123/456 |
| 8,951,023 | B2 * | 2/2015 | O'Connor | F04B 15/02 436/180 |
| 10,487,818 | B2 * | 11/2019 | Bilousov | F04B 9/105 |
| 2008/0022646 | A1 | 9/2008 | Eysymontt et al. | |
| 2008/0226466 | A1 * | 9/2008 | Eysymontt | F04B 43/1136 417/63 |
| 2009/0060764 | A1 * | 3/2009 | Mitzlaff | A61B 17/3203 417/460 |
| 2010/0258084 | A1 * | 10/2010 | Lundgren | F02D 19/0665 123/456 |
| 2014/0319181 | A1 * | 10/2014 | Tremel | B41J 2/175 222/389 |
| 2020/0132058 | A1 * | 4/2020 | Mollatt | F04B 45/033 |

* cited by examiner

PUMP ASSEMBLY

This application is the U.S. national phase of International Application No. PCT/RU2019/000700 filed Oct. 2, 2019, which claims priority to Russian Application No. 2018134507 filed Oct. 2, 2018, the entire contents of each of which are hereby incorporated by reference.

FIELD OF THE INVENTION

The invention relates to pumping assemblies designed for pumping fluids with high content of solid particles and/or aggressive or toxic liquids and lifting them from any depths including lifting from deep boreholes.

BACKGROUND

A bellows pump with hydraulic drive for pumping water or contaminated liquids is known. Such pump consists of at least two pumping units. Each pumping unit comprises a working-fluid-controlled hydraulic cylinder as the drive coupled with a separate hydraulic cylinder for dosed working fluid injecting to or pumping out of the working-fluid-controlled hydraulic cylinder. Each working-fluid-controlled hydraulic cylinder comprises a bellows closed in its lower end part and open in its upper end part for connection with the working fluid. The bellows is placed into a chamber filled with the pumped fluid [WO2015128283, Hydraulically driven bellows pump, published Sep. 3, 2015] [1].

One of the disadvantages of this pump consists in friction arising during operation of the hydraulic cylinder in the pump discharge line. This friction causes significant power consumption during operation. Another disadvantage is in possible leaking through seals on the piston, which separates the working fluid inside the diaphragm from that in the discharge line. Besides, installation of any additional equipment increases its overall dimensions. The working-fluid-controlled hydraulic cylinder has a hole in its lower part operating as the pumped fluid inlet/outlet port. However, such arrangement of the inlet/outlet port may cause contamination of internal chamber inside the working-fluid-controlled cylinder and/or formation of air bubbles in upper part of the cylinder.

The present technical solution differs from above described prior art in the following design features:

Working fluid is injected by a force pump directly into internal chamber of the rolling diaphragm (bellows) inside the discharge line. Therefore, there is no friction pairs.

Working fluid is pumped off the internal chamber of the bellows inside the discharge line by a special draw-off pump.

Pumping assembly housing has few inlet/outlet ports, wherein the inlet port is located in lower part of housing while the outlet port is located in the upper part of housing.

A GEHO® APEXS type pump of Weir Minerals Netherlands is also known.

This pump is a double-chamber single-acting high-pressure hose plant with hydraulic drive designed for pumping any contaminated liquids. The plant has a rigid housing and a flexible tubular assembly inside the housing. This assembly comprises at least two working-fluid-controlled hydraulic cylinders. Each working-fluid-controlled hydraulic cylinder comprises a deformable member in the form of an elastic pipe closed in its upper end part and open in its lower end part for the pumped fluid. The elastic pipe is placed into a chamber filled with the working fluid. Injecting or pumping off the working fluid to or from the chamber of working-fluid-controlled cylinder causes respective changes in working volume of the said elastic pipe. Consequently, operation of such pump consists in alternating injecting and pumping off the working fluid to or from the working-fluid-controlled cylinder chamber [Application WO2004011806, IPC F04B43/10; F04B43/113. Fluid operated pump/Combined Resource Engineering [AU]; Morris Gordon Leith; West Robert Leslie.—Application WP2003AU00953; filed Jul. 29, 2003; published Feb. 5, 2004].

This type of pumps suffers from the disadvantage inherent to usage of an elastic pipe as the working body to provide changes in working volume. Namely, the elastic pipe is stretched during operation, which leads to faster wear of the working body. Besides, the working-fluid-controlled cylinders must be inclined at an angle to horizon. However, inclined position can cause clogging (deposition of mechanical impurities) since the working-fluid-controlled hydraulic cylinder has a single hole in its lower part operating as the pumped fluid inlet/outlet port, while application of the elastic tubular diaphragm requires a complex system to monitor and control the working position of the diaphragm in extended or compressed state. Moreover, deformation of the elastic tubular diaphragm must obey a well-known law in order that such system was operable.

SUMMARY OF THE INVENTION

The aim of this invention is to present a high-performance pumping assembly.

The technical results of this invention consist in reducing weight and overall dimensions of the pump assembly as well as increasing energy efficiency and reliability. The first said result is achieved by using a longitudinally stretchable bellows, which in turn allows to apply a lighter and more compact cylindrical pump housing with the cylinder length-to-diameter ratio of 2 to 1 or more, whereas larger working volume of the bellows per stroke allows to reduce the number of cycles at the same productivity and thereby increase the life of bellows.

A direct hydraulic drive, designed as a system of hydraulic valves and hydraulic pumps that alternately connects hydraulic lines to internal chamber of the bellows, has no friction pairs inherent to other types of bellows pumps, in particular, piston or plunger pumps, and hence is friction-free and maintenance-free. At the same time, all hydraulic drives are several times smaller in size and weight compared to piston or plunger drives equipped with cumbersome and heavy crank gears at the same rated capacities.

Another result of the invention is achieved by improving energy efficiency due to combining the bellows and the direct hydraulic drive with at least two independent hydraulic lines such that at least one line is under working fluid pressure below the pumped fluid inlet pressure, and at least one line is under working fluid pressure higher than the pumped fluid inlet pressure.

Yet another result of the invention is achieved due to the fact that the pumping assembly comprises a housing consisting of at least two parts with internal cylindrical chambers and having holes for supplying and discharging the pumped fluid; two or more longitudinally stretchable bellows attached with one end surface to each part of the housing from inside, the opposite end side of each bellows being closed with a plug, while the end surface of each part of housing connected with the bellows having a hole for supplying the working fluid to the internal chamber bounded by the bellows, its plug, and the end surface of the part of the housing; and a pumping assembly hydraulic control system, wherein the pumping assembly hydraulic control system comprises a tank containing the working fluid; a force pump; two or more independent hydraulic lines, and a valve system capable to alternately connect internal chambers of bellows to the first or second line depending on positions of the bellows, the hydraulic lines being designed in such a way that the first line is under working fluid pressure below the pumped fluid inlet pressure and the second line is under working fluid pressure higher than the pumped fluid inlet pressure; internal chamber of each bellows is connected to the said lines with the possibility of alternatively switching between the force pump for supplying the working fluid via the first hydraulic line and the tank containing the working fluid via the second hydraulic line, and the pumping assembly further comprises means for tracing position of each bellows being configured to control alternate connection of internal chamber of each bellows to the first or second line depending on the bellows position.

In one particular embodiment of the present invention, means for tracing position of each bellows are installed in internal chamber of this bellows and comprise a fixed tube and rod, one end of the rod being attached to the bellows plug and the other end being loosely inserted in the tube attached to the surface opposite to the bellows plug. Rod position transducers are installed on the tube at a distance of bellows stroke.

In one particular embodiment of the present invention, a pump is additionally installed on the second hydraulic line for pumping the working fluid into the tank.

In one particular embodiment of the present invention, means for tracing position of each bellows are installed in internal chamber of this bellows and comprise position transducer, rod and tube, one end of the rod being attached to the bellows plug and the other end being loosely inserted in the tube attached to the surface opposite to the bellows plug. The rod has marks (e.g., 200a-200n) to control the rod position.

In one particular embodiment of the present invention, means for tracing position of each bellows are installed in internal chamber of this bellows and comprise position transducer, revolvable spool, and a cable wound around the spool, the spool being attached to the surface opposite to the bellows plug, while the wound cable having one end fixed on the plug.

In one particular embodiment of the present invention, means for tracing position of each bellows comprise a rotation speed sensor mounted on the force pump and designed to monitor filling of internal chamber of the bellows by determining the working fluid volume necessary to fill the internal chamber of the bellows.

In one particular embodiment of the present invention, holes for supplying and discharging the pumped fluid are made in the lower and/or upper part of pump housing.

In one particular embodiment of the present invention, a bellows is made composite of individual elastic membranes connected in series with each other by end surfaces.

BRIEF DESCRIPTION OF DRAWINGS

These and other features and advantages of the invention will become better understood when considered in conjunction with the following detailed description and by referring to the appended drawings, wherein.

Figure 1:
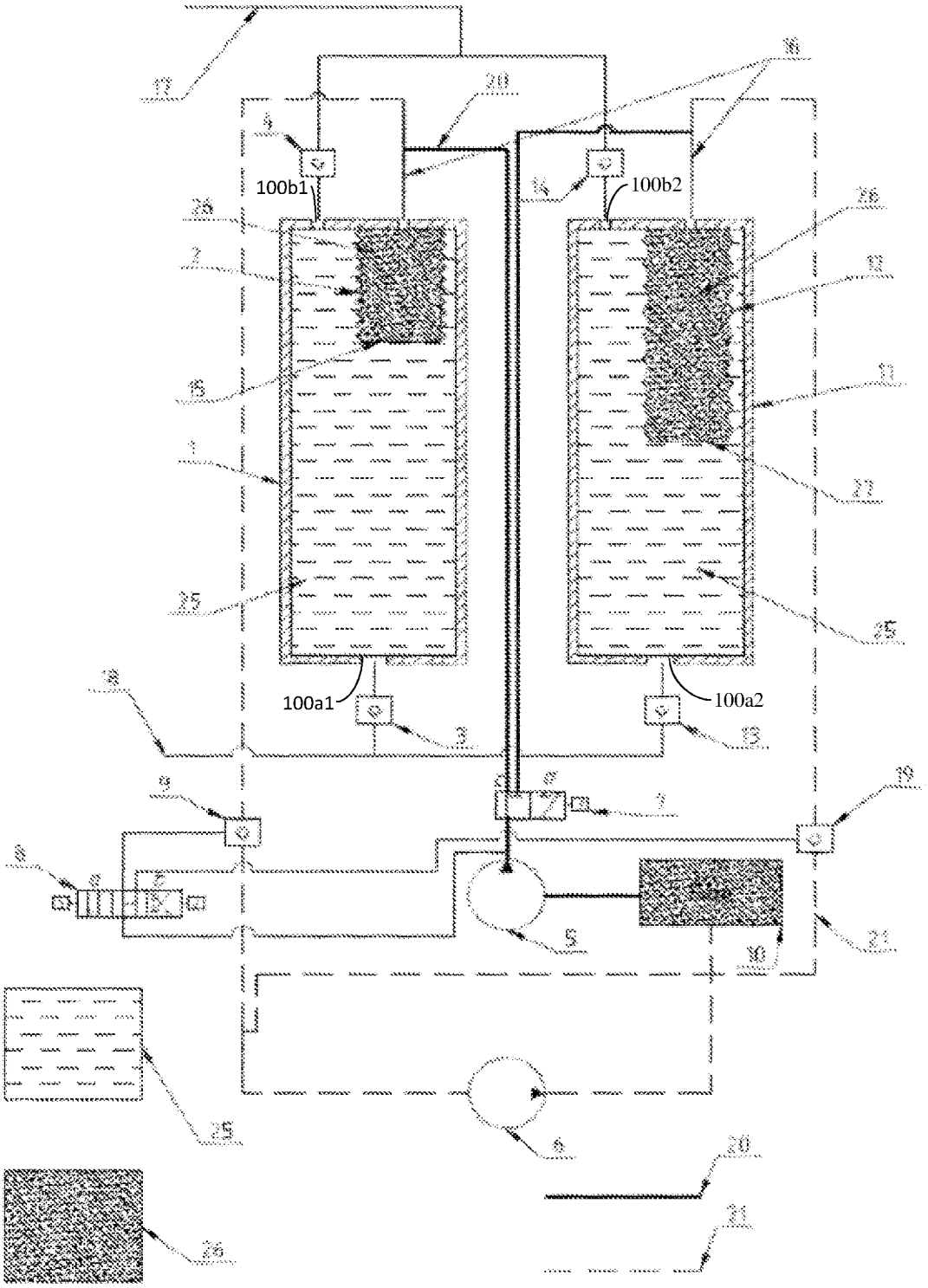
FIG. 1 is a general view of the pumping assembly.

Numbers in the drawings indicate the following items: 1—first part of housing; 2—bellows; 3—suction valve; 4—discharge valve; 5—force pump; 6—draw-off pump; 7—discharge pressure control hydraulic distributor; 8—hydraulic distributor; 9—pilot-operated valve; 10—tank with a working fluid; 11—second part of housing; 12—second bellows; 13—suction valve; 14—discharge valve; 15—plug of the first bellows; 16—hydraulic control system of pumping assembly; 17—discharge line; 18—suction line; 19—pilot-operated valve; 20—first hydraulic line; 21—second hydraulic line; 22—transducer of lower position; 23—rod; 24—tube; 25—pumped fluid; 26—working fluid; 27—plug of the second bellows; 28—rod; 29—limit switch; 30—limit switch; 31—transducer of upper position; 32—valve; 33—valve; 34—valve; 35—valve; 36—hydraulic distributor; 37—hydraulic distributor; 38—hydraulic distributor; 39—hydraulic distributor; 40—control pump; 41—control line; 42—hydraulic lock; 43—hydraulic lock; 44—hydraulic lock; 45—hydraulic lock; 46—sensor; 47—sensor; 48—spool; 49—spool; 50—rotation speed sensor.

Besides, letters "a" and "b" indicate positions of hydraulic distributor for the force line control (7) while letters "c" and "d" show similar positions of hydraulic distributor (8).

DETAILED DESCRIPTION OF THE INVENTION

Pumping assembly (FIG. 1) comprises a housing consisting of at least two parts (1) and (11), each part (1) and (11) of the pumping assembly housing having a cylindrical internal chamber. Bellows (2) and (12) are installed inside each of said housing parts (1) and (11) of the pumping assembly housing. These bellows (2) and (12) are mounted on inner upper or lower end surface of each housing part (1) and (11) of the pumping assembly housing, respectively.

Each bellows (2) and (12) is closed in its free end with a plug (15) or (27), respectively. The chamber, formed by bellows (2) or (12), mounted on end surface of housing part (1) or (11) of the pumping assembly housing, and its plug (15) or (27), closing free end of bellows (2) or (12), respectively, is referred as the inner chamber of bellows (2) or (12). Bellows (2) and (12) with plugs installed inside parts (1) and (11) of the pumping assembly housing separate the working fluid (26) occurring in inner chambers of bellows (2) and (12) from the pumped fluid (25) occurring outside the bellows (2) and (12) in the same chambers of parts (1) and (11) of the pumping assembly housing.

Each part (1) or (11) of the pumping assembly housing has inlet or outlet port (holes **100*a*1-100*a*2 and 100*b*1-100*b*2) suitable to connect the suction line (18) or discharge line (17), respectively. A discharge valve (4) or (14) is installed on the discharge line (17) of the pumped fluid (25). A suction valve (3) or (13) is installed on the suction line (18**) of the pumped fluid.

The pumping assembly further comprises a pumping assembly hydraulic control system (16), in turn comprising a tank (10) containing the working fluid; a force pump (5); two or more independent hydraulic lines (20) and (21), and a valve system.

The pumping assembly operation hydraulic control system (16) consists of two independent hydraulic lines (20) and (21).

The first hydraulic line (20) is under pressure higher than the pumped fluid (25) inlet pressure in the suction line (18).

The second hydraulic line (21) is under pressure lower than the pumped fluid (25) inlet pressure in the suction line (18).

The first hydraulic line (20) of the pumping assembly control line (16) connects each bellows (2) and (12) with discharge pump (5) to supply the working fluid (26), the discharge pump being a component of the pumping assembly. The connection of each bellows (2) and (12) with discharge pump (5) is governed by a discharge pressure control hydraulic distributor (7) installed on the first hydraulic line (20). The discharge pressure control hydraulic distributor (7) is designed to distribute supplied working fluid (26) among said bellows (2) and (12). The first hydraulic line (20) of the pumping assembly control line (16) also connects the pump (5) designed for supplying the working fluid (26) with the tank (10) containing the working fluid.

At the same time, the first hydraulic line (20) connects the pump (5), designed for supplying the working fluid (26) to each bellows (2) and (12), with the hydraulic distributor (8) designed to unlock or lock the pilot-operated valve (9) or (19). The pilot-operated valves (9) and (19) are installed at junctions of respectively first and second hydraulic lines (20) and (21) of the control line (16).

The second hydraulic line (21) of the control line (16) connects each bellows (2) and (12) with draw-off pump (6) designed to pump off the working fluid (26), the draw-off pump being a component of the pumping assembly. The second hydraulic line (21) also connects the pump (6), designed to pump off the working fluid (26), with the tank (10) containing the working fluid.

Operating cycle of whole pumping assembly (FIG. 1) may be divided into two stages depending on position (c) or (d) of the discharge pressure control hydraulic distributor (7).

When the discharge pressure control hydraulic distributor (7) is in its initial position (c), the pumping assembly operates as follows:

Pumped fluid (25) enters the suction line (18). The discharge pressure control hydraulic distributor (7) switches to position (c) and simultaneously hydraulic distributor (8) switches to position (b), thereby causing opening of pilot-operated valve (19) and closing of pilot-operated valve (9). The force pump (5) and draw-off pump (6) ensure circulation of working fluid (26) in the control line (16) of the pumping assembly.

As a result of above actions, draw-off pump (6) begins to draw off working fluid (26) from inner chamber of the second plugged bellows (12) into tank (10), while the force pump (5) begins to supply the working fluid into inner chamber of plugged bellows (12) from the tank (10). Removal of working fluid (26) from inner chamber of the second bellows (12) closed with a plug (27) in its free end creates underpressure in pumped fluid inside the second housing part (11), thereby opening suction valve (13) and closing the discharge valve (14) on the pumped fluid line. This underpressure causes filling of second housing part (11) with the pumped fluid (25).

At the same time, excessive working fluid in inner chamber of the first bellows (2) closed with a plug (15) in its free end, which is supplied by the force pump (5), creates overpressure inside the first housing part (1), thereby closing suction valve (3) and opening the discharge valve (4). As the working fluid (26) is injected into internal chamber of the first bellows (2) closed with a plug (15) in its free end, the pumped fluid is forced out into discharge line (17). Consequently, plugged bellows (2) and (12) move in anti-phase to each other.

When the bellows (2) with the plug (15) reaches the extreme extended state, while the bellows (12) with the plug (27) reaches the extreme compressed state, the discharge pressure control hydraulic distributor (7) switches to position (d).

When the discharge pressure control hydraulic distributor (7) is in its initial position (d), the pumping assembly operates as follows:

The discharge pressure control hydraulic distributor (7) switches to position (d) and simultaneously hydraulic distributor (8) switches to position (a) thereby causing opening of pilot-operated valve (9) and closing of pilot-operated valve (19). The force pump (5) and draw-off pump (6) ensure circulation of working fluid in the control line of the pumping assembly.

As a result of above actions, draw-off pump (6) begins to draw off working fluid from inner chamber of the first bellows (2) with the plug (15) into tank (10), while the force pump (5) begins to supply working fluid into inner chamber of bellows (12) with the plug (27) from the tank (10). Removal of working fluid from inner chamber of the first bellows (2) closed with a plug (15) in its free end creates underpressure in pumped fluid inside the first housing part (1), thereby opening suction valve (3) and closing the discharge valve (4). This underpressure causes filling of first housing part (1) with the pumped fluid (25).

At the same time, excessive working fluid in inner chamber of the first bellows (12) closed with a plug (27) in its free end, which is supplied by the force pump (5), creates overpressure inside the first housing part (11), thereby closing suction valve (13) and opening the discharge valve (14). As the working fluid is injected into internal chamber of the second bellows (12) closed with a plug (27) in its free end, the pumped fluid (25) is forced out into discharge line (17).

When the bellows (12) with the plug (27) reaches the extreme extended state, while the bellows (2) with the plug (15) reaches the extreme compressed state, the discharge pressure control hydraulic distributor (7) switches back to position (c). Then the cycle is repeated.

Below are disclosed embodiments of the present invention with bellows (2) and (12) position control using either position transducers (22), (31) and rod (23) or limit switches (29) and (30).

Figure 2:
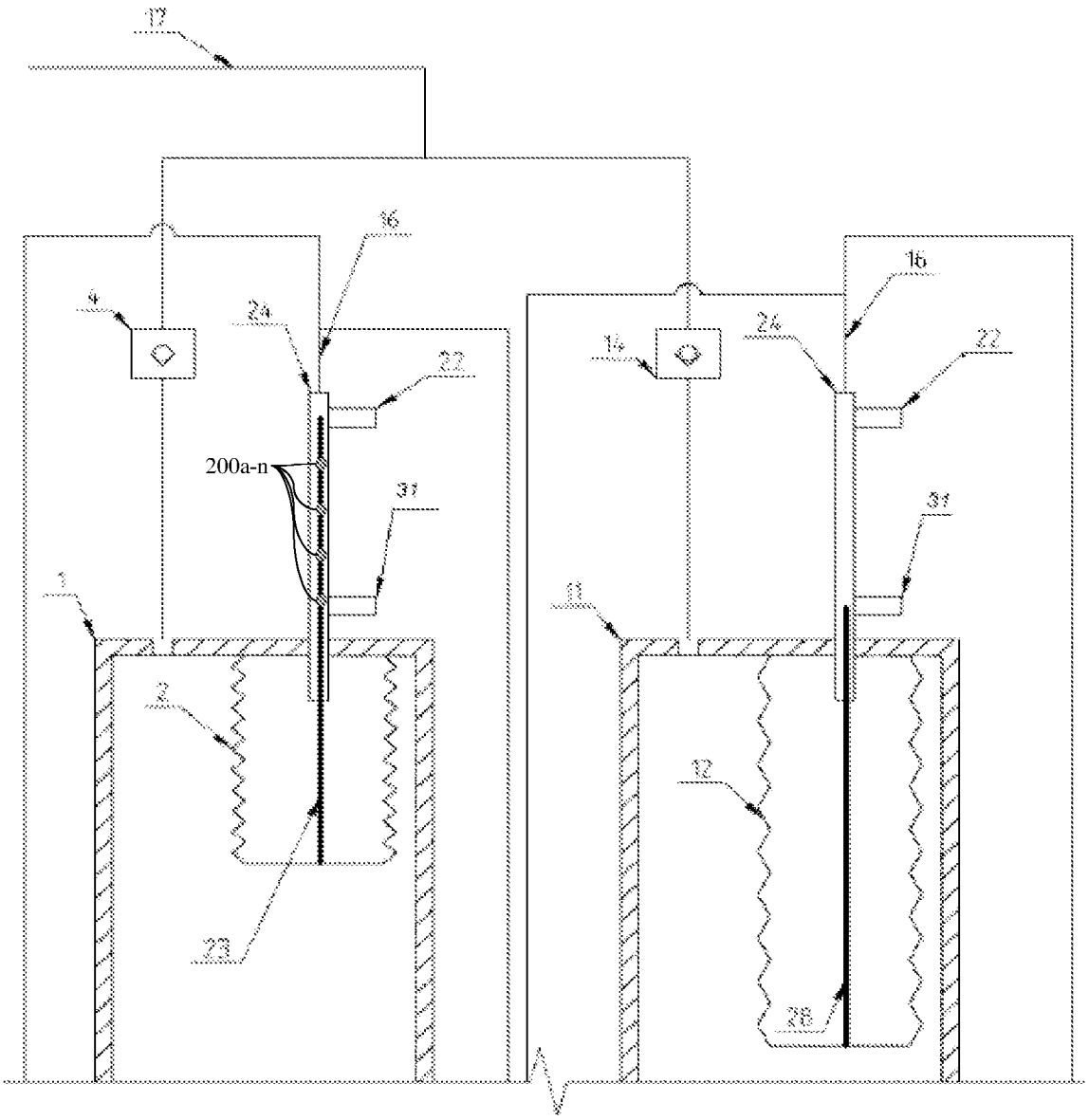
FIG. 2 is a view of rod and position monitoring transducers.

One embodiment of the claimed invention provides determining positions of bellows (2) and (12) with the aid of position transducers (22), (31) and rod (23) (FIG. 2), the rod (23) moving in tube (24) with two installed position transducers (22), (31) at a distance of bellows stroke. The rod (23) is installed in the inner chamber of each bellows (2) and (12) closed in its end part with a plug (15) or (27), respectively. The rod (23) has holes drilled in its body. One end of rod (23) is attached to the plug (15) or (27), while the other end is loosely inserted in the tube (24). Tubes (24) are fixed in each housing part (1) and (11), respectively. Rod position transducers (22) and (31) are installed on each tube (24) perpendicularly to its axis. Upper position transducers (22) are located in the upper part of each tube (24), whereas the lower position transducers (31) are located in the lower part of each tube (24). The distance between upper position transducers (22) and lower position transducers (31) must be equal or less than stroke of bellows (2) or (12) closed with plug (15) or (27), respectively. When bellows (2) or (12) is in the extreme extended state, upper end of the rod (23) must be opposite the lower position transducer (31). At this moment, the lower position transducer (31) transmits signal "bellows is extended", which switches discharge pressure control hydraulic distributor (7) and hydraulic distributor (8). Thereafter the rod (23) starts to move up. When the rod (23) reaches the upper position transducer (22), the upper position transducer (22) transmits signal "bellows is compressed", which switches discharge pressure control hydraulic distributor (7) and hydraulic distributor (8) again.

Another embodiment of the claimed invention provides determining position of bellows with the aid of a single position transducer in combination with the rod (23), wherein the rod has two holes for position control. In this embodiment, alternate values "bellows is extended" and "bellows is compressed" are assigned to signals generated by the transducer when a hole in the rod (23) aligns with the transducer's working surface.

Figure 3:
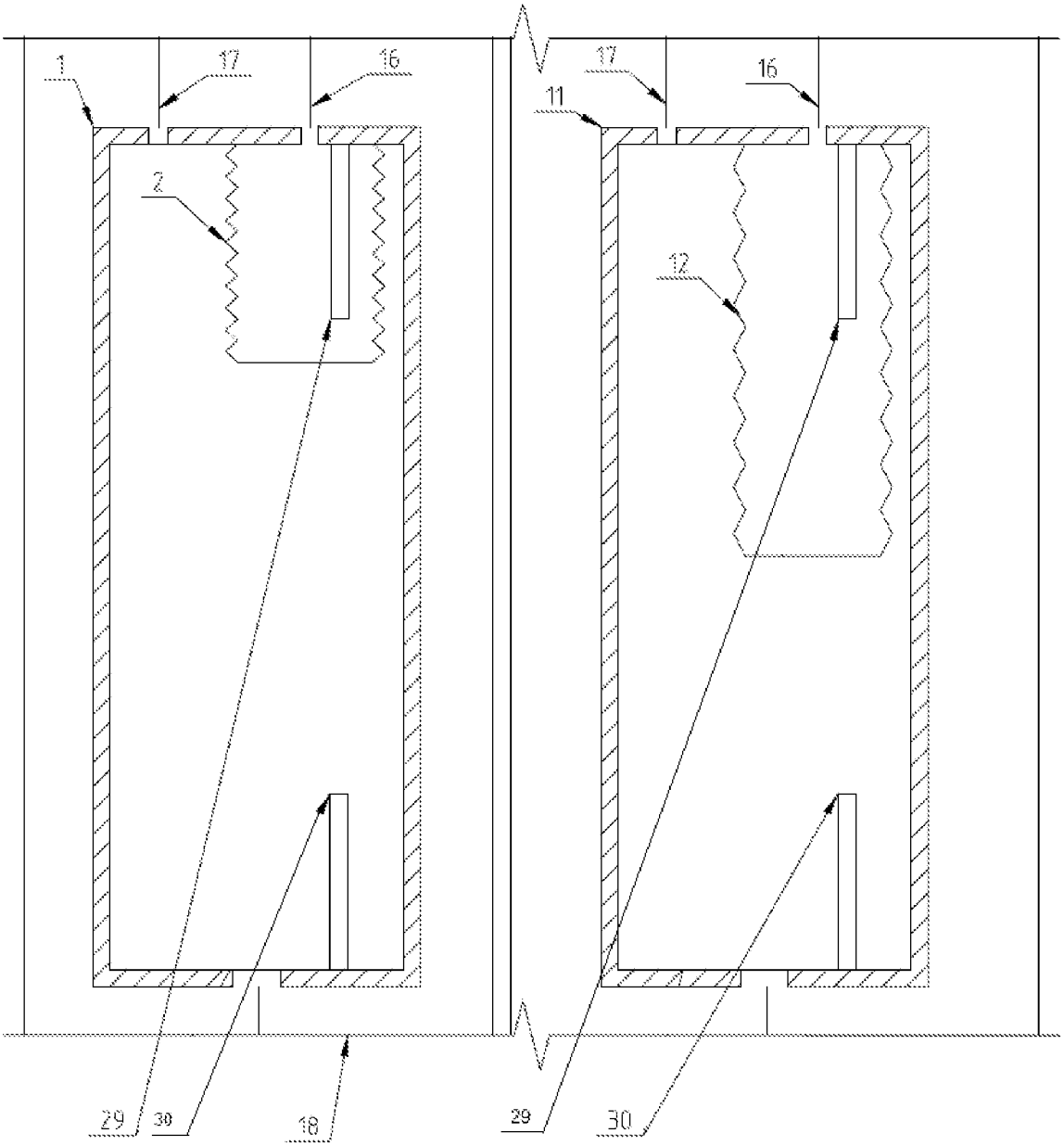
FIG. 3 is a view of limit switch.

Yet another embodiment of the claimed invention with bellows position control using limit switches (29) and (30) (FIG. 3) provides determining positions of bellows (2) and (12) closed with plugs (15) or (27) in their free ends, respectively, based on touching limit switches by the plugs. In this embodiment of the claimed invention, lower limit switches (30) are installed in lower end of each housing part (1) and (11) while upper limit switches (29) are installed in upper end of each bellows (2) and (12). When a plugged bellows (2) or (12) extends to the maximum and its plug touches the lower limit switch (30), the switch transmits signal "bellows is extended", which switches discharge pressure control hydraulic distributor (7) and hydraulic distributor (8). Thereafter the plugged bellows (2) or (12) starts to move up. When a plugged bellows (2) or (12) reaches its extreme compressed state and its plug (15) or (27), respectively, touches the upper limit switch (29), the upper limit switch (29) transmits signal "bellows is compressed", which switches discharge pressure control hydraulic distributor (7) and hydraulic distributor (8) back.

Figure 8:
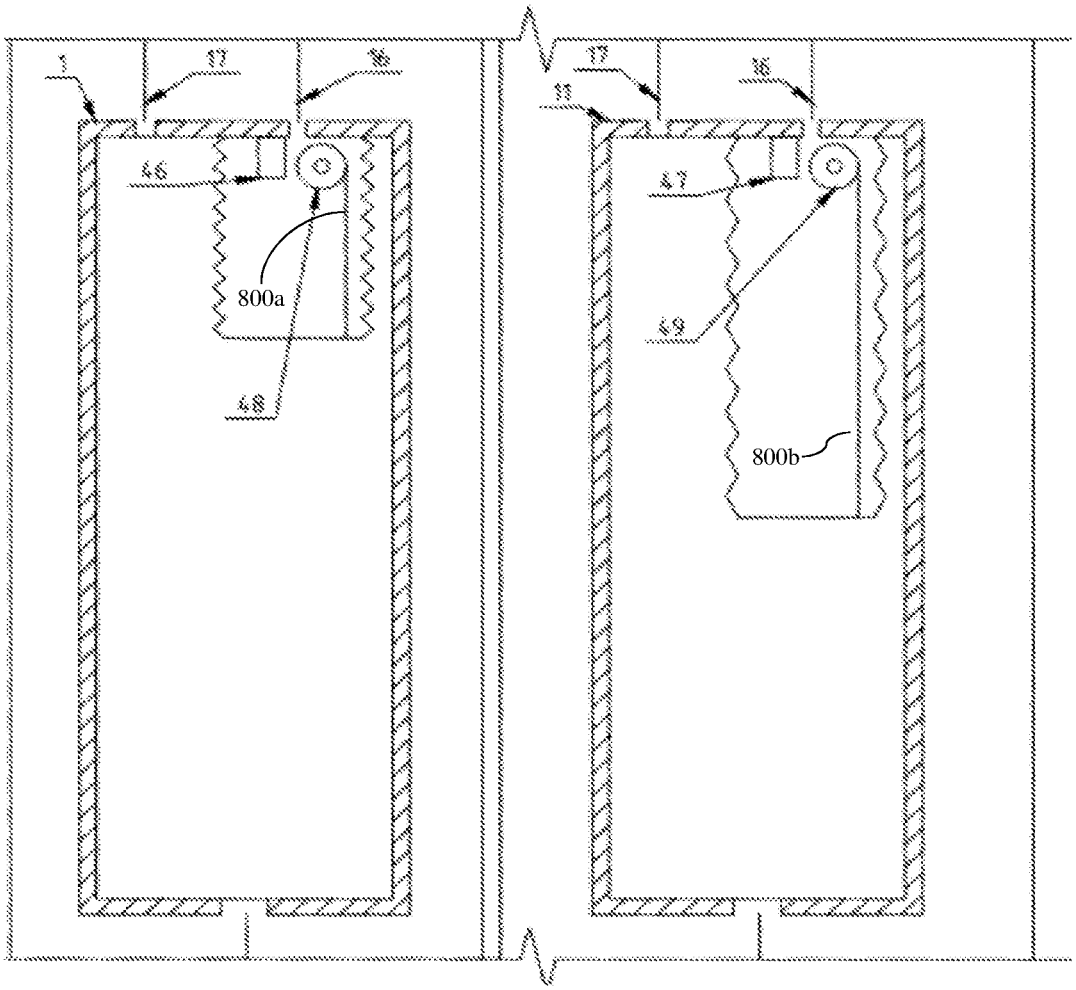
FIG. 8 is a view of one embodiment of bellows position control system.

Still another embodiment of the claimed invention (FIG. 8) provides determining positions of bellows with the aid of a cable (800*a*, 800*b*) wound on a spool (48) and (49). Spools (48) and (49) are installed in the upper parts of the pumping assembly housing parts (1) and (11), and ends of cables (800*a*, 800*b*) are fixed on plugs (15) and (27), respectively. The reciprocating movement of bellows (2) and (12) leads to unwinding and subsequent winding the cable (800*a*, 800*b*) onto each spool (48) and (49). In turn, rotational movement of spools (48) and (49) caused by displacements of bellows is detected by transducers (46) and (47). Transducers (46) and (47) may be of either contact or contactless type.

Figure 9:
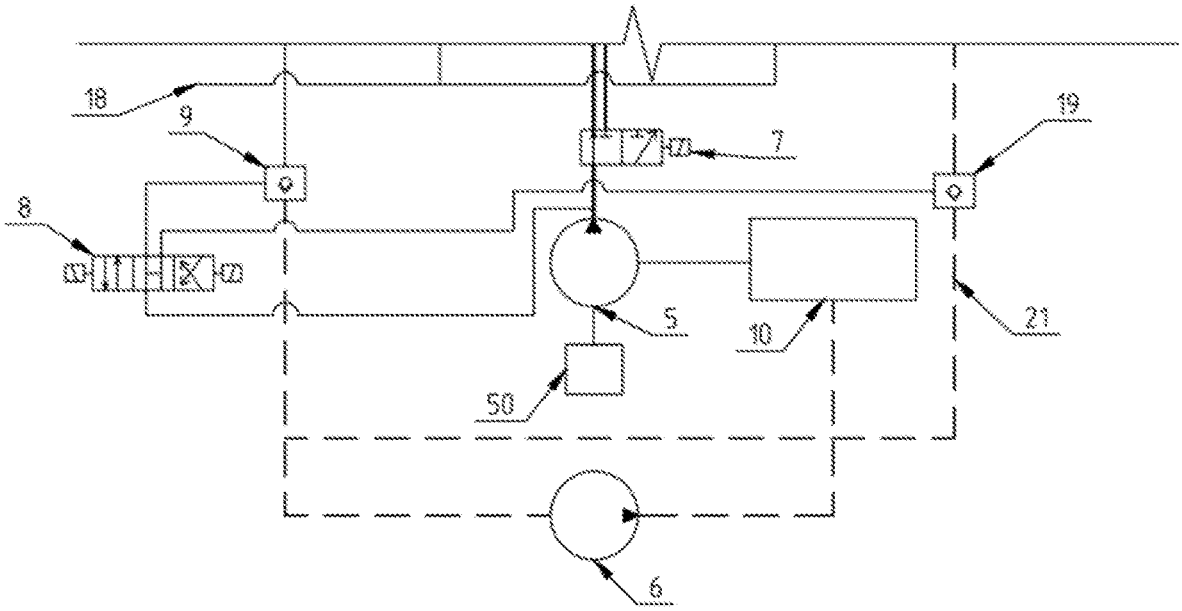
FIG. 9 is a view of another embodiment of bellows position control system.

Still other embodiments of the claimed invention are possible based on indirect rather than direct methods of the membrane (bellows) (2) and (12) position control. In particular, bellows position can be determined (FIG. 9) using the controlled filling of inner chambers of bellows (2) or (12) closed in their end parts with plugs (15) or (27), respectively, with a working fluid (26) supplied by a force pump (5). In this case, a rotation speed sensor (50) is mounted on the force pump (5) and used to calculate the working fluid volume required to fill the inner chamber of bellows (2) or (12) closed in its end part with plug (15) or (27), respectively.

Above disclosed embodiments cannot fully cover all possible approaches to tracking position of bellows closed with a plug in its lower part.

In addition, the pumping assembly may comprise more than two parts of housing. Accordingly, increase in number of housing parts causes the necessity to install a number of additional components per each additional part, namely:

discharge pressure control hydraulic distributor (7)
hydraulic distributor (8)
housing part or parts (1) and (11)
discharge valves (4), (14)
suction valves (3), (13)
pilot-operated valves (9), (19)

Figure 4:
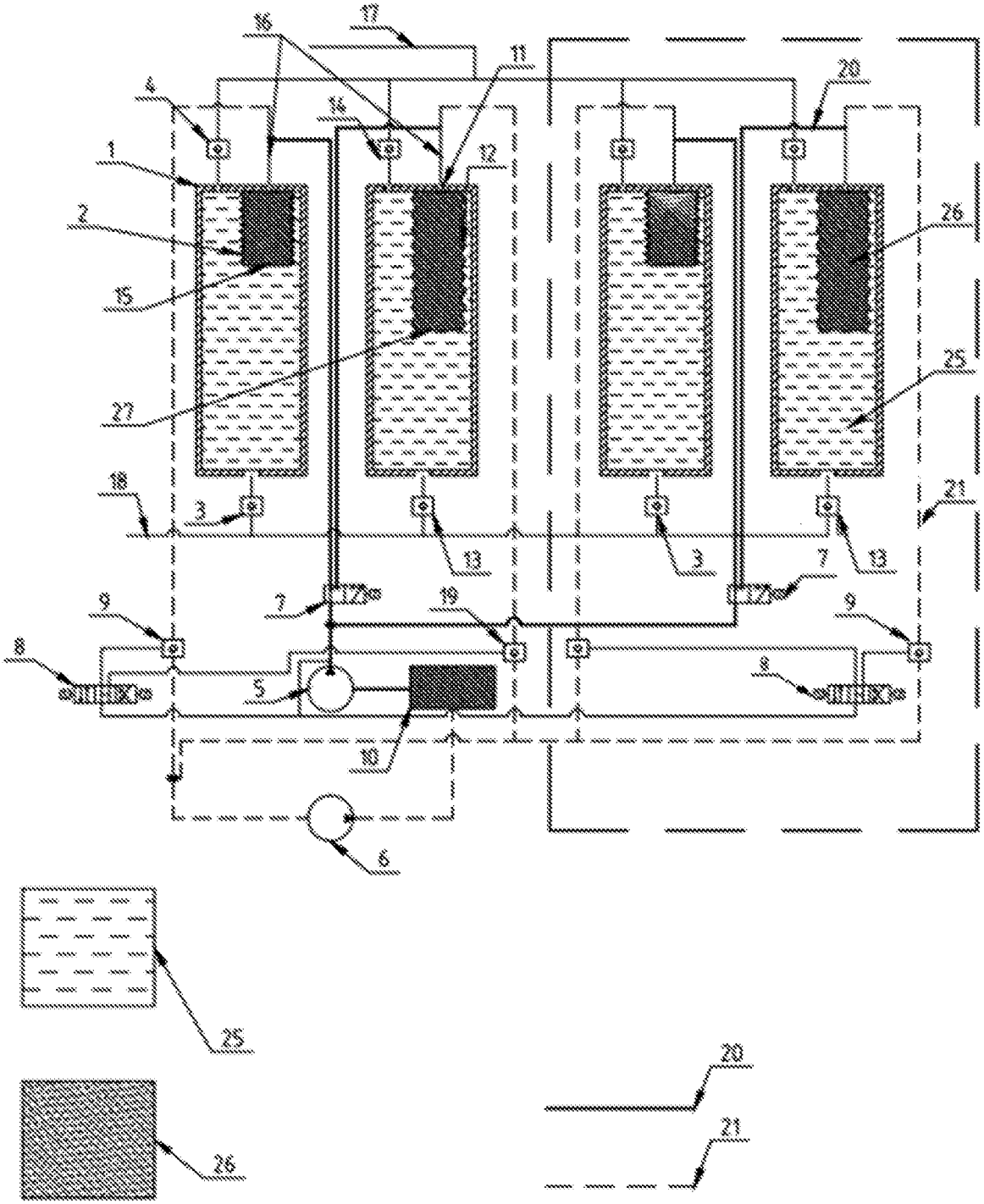
FIG. 4 is a view of a pumping assembly according to one embodiment with an additional group of housings with cylindrical chambers.

Above components of the pumping assembly are interconnected via first and second hydraulic lines (20) and (21) (FIG. 4).

Once more embodiment of the present invention discloses a pumping assembly (FIG. 4) that comprises a housing divided into four parts, each part having a cylindrical internal chamber. Bellows are installed inside each of said housing parts of the pumping assembly housing. Each of these bellows is attached to upper end inner surface of each housing part of the pumping assembly. Each bellows is closed with a plug at the bottom. The chamber formed by bellows mounted on upper end surface of housing part of the pumping assembly housing and its plug is referred as the inner chamber of bellows. Bellows with plugs installed inside parts of the pumping assembly housing separate the working fluid (26) occurring in inner chambers of bellows from the pumped fluid (25) occurring outside the bellows in the same chambers of parts of the pumping assembly housing.

Each part of the pumping assembly housing has inlet or outlet port suitable to connect the suction line (18) or discharge line (19), respectively.

Discharge valves are installed on the discharge line (17) of the pumped fluid (25). Suction valves are installed on the suction line (18) of the pumped fluid.

The pumping assembly operation control line (16) consists of two independent hydraulic lines (20) and (21).

The first hydraulic line (20) is under pressure higher than the pumped fluid (25) inlet pressure in the suction line (18). The second hydraulic line (21) is under pressure lower than the pumped fluid (25) inlet pressure in the suction line (18).

The first hydraulic line (20) of the pumping assembly control line (16) connects each bellows with discharge pump (5) to supply the working fluid (26), the discharge pump being a component of the pumping assembly. The connection of each bellows pair with discharge pump (5) is governed by a discharge pressure control hydraulic distributor installed on the first hydraulic line (20). The discharge pressure control hydraulic distributor is designed to distribute supplied working fluid (26) among said bellows. The first hydraulic line (20) of the pumping assembly control line (16) also connects the pump (5) designed for supplying the working fluid (26) with the tank (10) containing the working fluid.

At the same time, the first hydraulic line (20) connects the pump (5), designed to supply the working fluid (26) to each bellows pair, with the hydraulic distributor designed to unlock or lock the pilot-operated valves. One pilot-operated valve is installed on the second hydraulic line (21) of the control line (16).

The second hydraulic line (21) of the control line (16) connects each bellows with draw-off pump (6) designed to pump off the working fluid (26), the draw-off pump being a component of the pumping assembly. The second hydraulic line (21) also connects the draw-off pump (6), designed to pump off the working fluid (26), with the tank (10) containing the working fluid.

Description of Valves and Control system

In order to control the pumping assembly, it is necessary to control flows of the working fluid. Such flow control is available mainly with the aid of various valves. In turn, valves can have electromagnetic, hydraulic, or pneumatic control.

Figure 5:
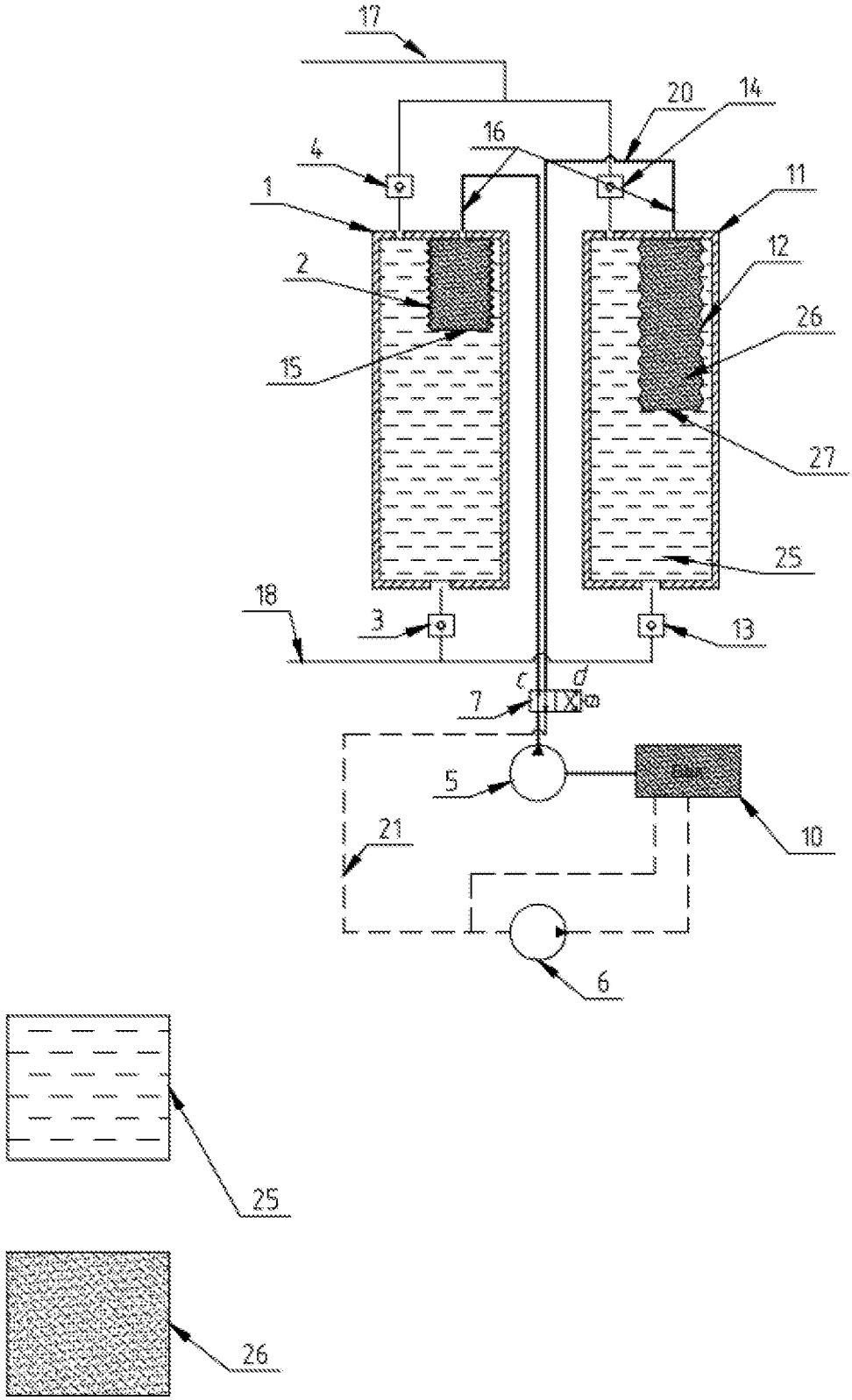
FIG. 5 is a view of working fluid control system in a pumping assembly according to one embodiment of the invention.

As FIG. 5 shows, working fluid control in the pumping assembly begins from the discharge pressure control hydraulic distributor (7). When the discharge pressure control hydraulic distributor (7) is switched to position (c), working fluid is forced into inner chamber of the first bellows (2) closed with the plug (15) in its free end part and simultaneously drawn off from inner chamber of bellows (12) closed with the plug (27) in its free end part. After completion of the half-cycle, the discharge pressure control hydraulic distributor (7) is switched to position (d), and working fluid is forced into inner chamber of the second bellows (12) closed with the plug (27) in its free end part and simultaneously drawn off from inner chamber of bellows (2) closed with the plug (15) in its free end part.

Figure 6:
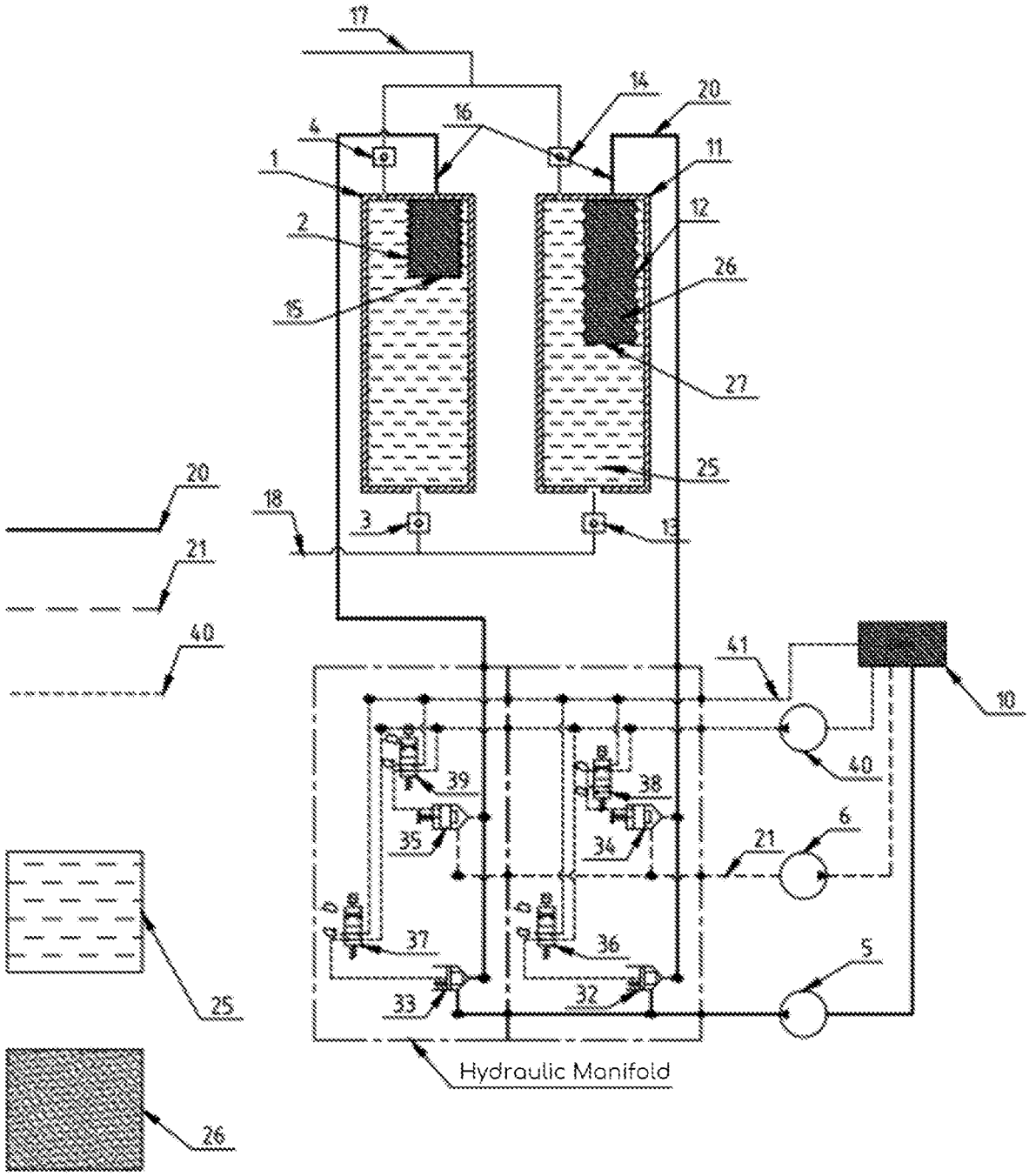
FIG. 6 is a view of working fluid control system in a pumping assembly according to another embodiment of the invention.

Another embodiment of flow control system shown in FIG. 6 provides working fluid control using a system of valves (32), (33), (34), (35), and hydraulic distributors (36), (37), (38), (39) acting via a control line (41). The working fluid control system is driven by a control pump (40) through the control line (41), valve system (32), (33), (34), (35), and hydraulic distributors (36), (37), (38), (39).

Operation of the pumping assembly (FIG. 6) is most easily understood in terms of positions of the hydraulic distributors (36), (37), (38), (39). When the hydraulic distributors (36), (37), (38), (39) are in positions (a), (b), (b), and (a), respectively, the force pump (5) supplies the working fluid to internal chamber of the first bellows (2) closed with a plug (15) in its free end. An overpressure arises inside the first housing part (1), thereby closing suction valve (3) and opening the discharge valve (4). As the working fluid is injected into internal chamber of the second bellows (2) closed with a plug (27) in its free end, the pumped fluid (25) is forced out into discharge line (17). At the same time, draw-off pump (6) begins to draw off working fluid from inner chamber of the second bellows (12) closed with plug (27) in its free end part.

When the bellows (2) with the plug (15) in its free end part reaches the extreme extended state, while the bellows (12) with the plug (27) in its free end part reaches the extreme compressed state, the hydraulic distributors (36), (37), (38), (39) switch in positions (b), (a), (a), and (b). Then the cycle is mirrored.

Figure 7:
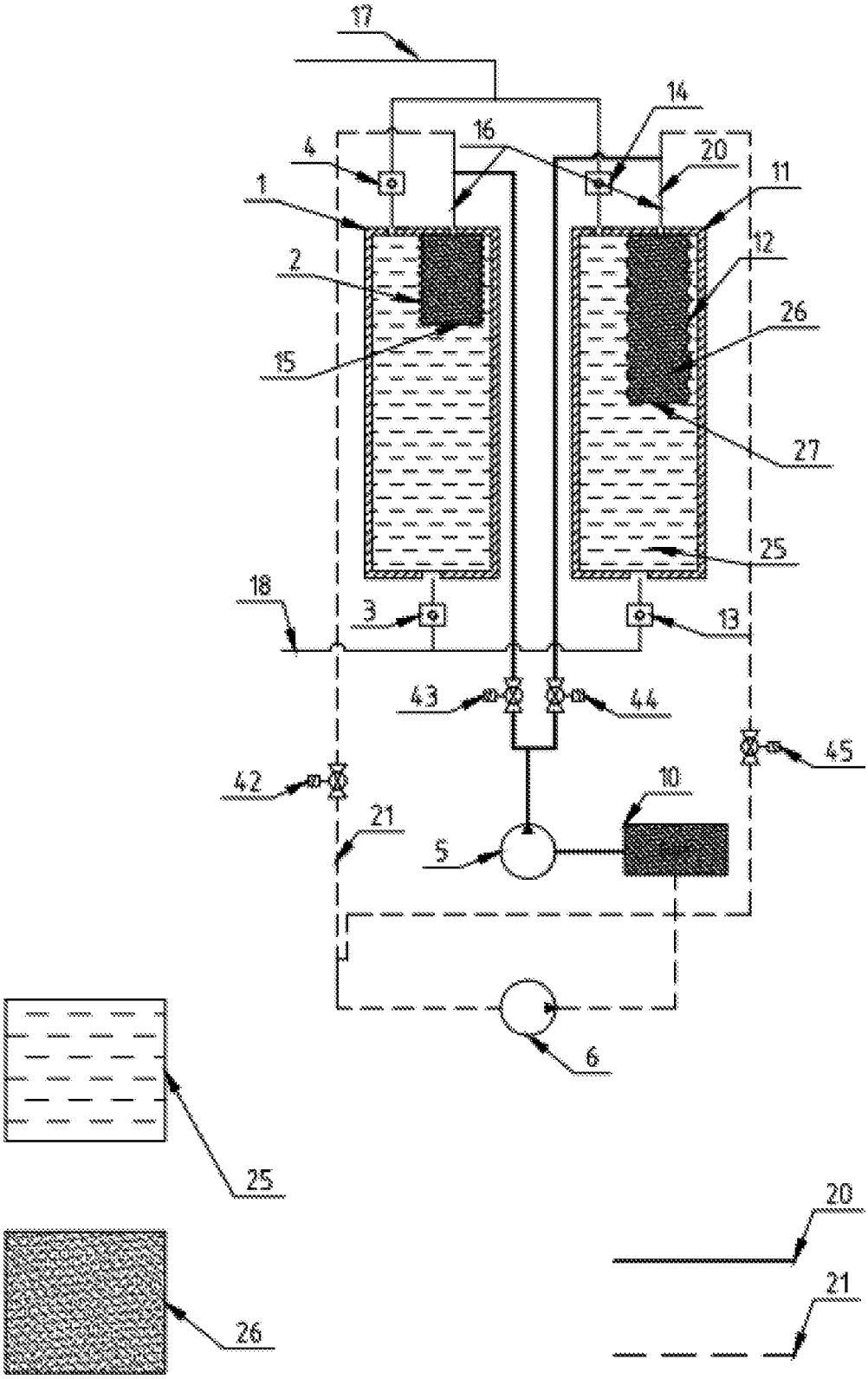
FIG. 7 is a view of working fluid control system based on a system of hydraulic locks with electromagnetic control in a pumping assembly according to another embodiment of the invention.

Yet another embodiment of flow control system shown in FIG. 7 provides working fluid control using a system of hydraulic locks (42), (43), (44), (45) with electromagnetic control. Operating cycle of pumping assembly with a system of electromagnetically controlled hydraulic locks (42), (43), (44), (45) may be divided depending on position of these hydraulic locks (open) or (closed).

When the hydraulic locks (42), (43), (44), (45) are in positions (closed), (open), (closed), and (open), respectively, the force pump (5) supplies the working fluid to internal chamber of the first bellows (2) closed with a plug (15) in its free end. An overpressure arises inside the first housing part (1), thereby closing suction valve (3) and opening the discharge valve (4). As the working fluid is injected into internal chamber of the second bellows (2) closed with a plug (27) in its free end, the pumped fluid (25) is forced out into discharge line (17). At the same time, draw-off pump (6) begins to draw off working fluid from inner chamber of the second bellows (12) closed with plug (27) in its free end part.

When the bellows (2) with the plug (15) in its free end part reaches the extreme extended state, while the bellows (12) with the plug (27) in its free end part reaches the extreme compressed state, the hydraulic locks (42), (43), (44), (45) switch in positions (open), (closed), (open), and (closed), respectively. Then the cycle is mirrored.

Essential features of the claimed invention:

A bellows is used as a working member. The bellows deforms longitudinally along its axis, which facilitates tracking working positions of the bellows. In addition, the bellows provides a largest possible volume change per stroke at minimal overall dimensions.

The working volume changes only due to longitudinal compression or extension of the bellows. Radial tensile stresses in bellows are absent, which allows to use reinforced materials and thereby increase service life of the pumping assembly.

Pumping assembly housing has both inlet and outlet ports. In embodiments of the claimed invention, inlet ports are located in the lower or upper part of the pumping assembly housing. Outlet ports in embodiments of the claimed invention are located oppositely, in the upper or lower part of the pumping assembly housing.

Alternating compression and tension of the bellows is forced by alternating connection of working chamber inside the pumping assembly to hydraulic lines, one of these lines being under working fluid pressure higher than the pumped fluid inlet pressure, while another line being under pressure below the pumped fluid inlet pressure.

The invention claimed is:

1. A pumping assembly, comprising a housing consisting of at least two parts with internal cylindrical chambers and having holes for supplying and discharging of a pumped fluid;

at least two longitudinally deformable bellows attached with one end surface to each part of the housing from inside, an opposite end side of each bellows being closed with a plug, while the end surface of each part of the housing connected with the bellows having a hole for supplying a working fluid to an internal chamber restricted by the bellows, its plug and the end surface of the part of the housing; and a pumping assembly hydraulic control system, wherein the pumping assembly hydraulic control system comprises:

a tank containing the working fluid;

a force pump;

two or more independent hydraulic lines; and a valve system configured to alternately connect internal chambers of bellows to a first or second line depending on positions of the bellows, the hydraulic lines being designed in such a way that working fluid pressure in the first line is below than a pumped fluid inlet pressure and working fluid pressure in the second line is higher than the pumped fluid inlet pressure;

wherein the internal chamber of each bellows is connected to the said hydraulic lines in such a way to alternatively switching between the force pump for supplying the working fluid via the first hydraulic line and the tank containing the working fluid via the second hydraulic line, and wherein the pumping assembly further comprises a means for tracing position of each bellows being configured to control alternate connection of the internal chamber of each bellows to the first or second hydraulic line depending on the bellows position.

2. The pumping assembly according to claim 1, wherein the means for tracing position of each bellows is installed in the internal chamber of the bellows and comprises a fixed tube and a rod, one end of the rod being attached to the bellows plug and the other end being loosely inserted in the fixed tube attached to a surface opposite to the bellows plug, while rod position transducers are installed on the fixed tube at a distance of a bellows stroke.

3. The pumping assembly according to claim 1, wherein a pump is additionally installed on the second hydraulic line for pumping the working medium into the tank.

4. The pumping assembly according to claim 1, wherein the means for tracing position of each bellows is installed in the internal chamber of the bellows and comprises a position transducer, a rod and a tube, one end of the rod being attached to the bellows plug and the other end being loosely inserted in the tube attached to a surface opposite to the bellows plug, while the rod has marks to control position of the rod.

5. The pumping assembly according to claim 1, wherein the means for tracing position of each bellows is installed in the internal chamber of the bellows and comprises a position transducer, a revolvable spool, and a cable wound around the spool, the spool being attached to a surface opposite to the bellows plug, while one end of the cable is fixed on the plug.

6. The pumping assembly according to claim 1, wherein the means for tracing position of each bellows comprises a rotation speed sensor mounted on the force pump and designed to monitor filling of the internal chamber of the bellows by determining working medium volume necessary to fill the internal chamber of the bellows.

7. The pumping assembly according to claim 1, wherein holes for supplying and discharging the pumped medium are made in a lower and/or upper part of the housing.

8. The pumping assembly according to claim 1, wherein the bellows is made as a composite of individual elastic membranes connected in series with each other by end surfaces.

* * * * *